US012467264B2

(12) United States Patent
Birzhev Rudatskiy

(10) Patent No.: US 12,467,264 B2
(45) Date of Patent: Nov. 11, 2025

(54) TILE FOR CLADDING AND FOR PAVING

(71) Applicant: Sergii Birzhev Rudatskiy, Valencia (ES)

(72) Inventor: Sergii Birzhev Rudatskiy, Valencia (ES)

( * ) Notice: Subject to any disclaimer, the term of this patent is extended or adjusted under 35 U.S.C. 154(b) by 180 days.

(21) Appl. No.: 18/029,521

(22) PCT Filed: Sep. 29, 2021

(86) PCT No.: PCT/ES2021/070706
§ 371 (c)(1),
(2) Date: Mar. 30, 2023

(87) PCT Pub. No.: WO2022/069781
PCT Pub. Date: Apr. 7, 2022

(65) Prior Publication Data

US 2023/0287689 A1 Sep. 14, 2023

(30) Foreign Application Priority Data

Sep. 30, 2020 (ES) ..... ES202032126U

(51) Int. Cl.
*E04F 13/14* (2006.01)
*E01C 5/00* (2006.01)
*E04F 13/08* (2006.01)

(52) U.S. Cl.
CPC ..... *E04F 13/0889* (2013.01); *E01C 5/00* (2013.01); *E04F 13/142* (2013.01)

(58) Field of Classification Search
CPC ..... E04F 13/14; E04F 13/142; E04F 13/0889; E01C 5/00
See application file for complete search history.

(56) References Cited

U.S. PATENT DOCUMENTS 708,470 A * 9/1902 Flood ..... E04C 1/00 52/311.2
4,350,341 A * 9/1982 Wallace ..... A63F 9/10 D25/138

(Continued)

FOREIGN PATENT DOCUMENTS

AT 501162 A4 7/2006
ES 2113751 5/1998

(Continued)

OTHER PUBLICATIONS

Oficina Espanola De Patentes Y Marcas (Spanish Office of the Patents and Brand), International Search Report, mailed Dec. 30, 2021, in International Patent Application No. PCT/ES2021/070706, filed Sep. 29, 2021.

(Continued)

*Primary Examiner* — Paola Agudelo
(74) *Attorney, Agent, or Firm* — Thedford I. Hitaffer; Hitaffer, PLLC

(57) ABSTRACT

A tile for cladding and paving comprises a single body made from a ceramic material. The tile comprises a main area that has a substantially polygonal plan having between five and ten sides and at least one additional area located on at least one side of the main area. Each additional area has an irregular polygonal plan, such that one of the longer sides of the additional area faces one of the sides of the main area.

5 Claims, 5 Drawing Sheets

(56) References Cited

U.S. PATENT DOCUMENTS

| | | | | | |
|---|---|---|---|---|---|
| 4,773,790 | A | * | 9/1988 | Hagenah | E01C 5/06 404/38 |
| 5,201,843 | A | * | 4/1993 | Hair | E01C 5/00 404/41 |
| 5,267,810 | A | * | 12/1993 | Johnson | E01C 5/06 404/41 |
| 5,286,139 | A | * | 2/1994 | Hair | E01C 5/00 404/38 |
| 5,342,142 | A | * | 8/1994 | Barth | E01C 5/00 404/41 |
| 5,884,445 | A | * | 3/1999 | Woolford | B44F 11/04 D25/151 |
| 5,921,705 | A | * | 7/1999 | Hodson | E01C 5/06 404/41 |
| D424,212 | S | * | 5/2000 | Abbrancati | D25/113 |
| D429,530 | S | * | 8/2000 | Fleishman | D25/113 |
| D431,871 | S | * | 10/2000 | Abbrancati | D25/113 |
| 9,850,668 | B2 | * | 12/2017 | Della Pepa | B32B 13/02 |

FOREIGN PATENT DOCUMENTS

| | | | |
|---|---|---|---|
| WO | 9210610 | A1 | 6/1992 |
| WO | 9514818 | A1 | 6/1995 |

OTHER PUBLICATIONS

Oficina Espanola De Patentes Y Marcas (Spanish Office of the Patents and Brand), Written Opinion, mailed Dec. 30, 2021, in International Patent Application No. PCT/ES2021/070706, filed Sep. 29, 2021.

* cited by examiner

TILE FOR CLADDING AND FOR PAVING

CROSS-REFERENCE TO RELATED APPLICATIONS

This application, filed under 35 USC 371, is a U.S. National Stage Application of International Application No. PCT/ES2021/070706, filed Sep. 29, 2021, which claims priority to ES Application No. U202032126, filed on Sep. 30, 2020, the disclosures of which are incorporated herein by reference in their entirety.

BACKGROUND OF THE INVENTION

This invention relates to In order to carry out the paving of large surfaces, whether in open or closed spaces, tiles are usually used, which are essentially made up of a body with a substantially rectangular or quadrangular plan, so that the decorative patterns are limited since the use of complex shapes, requires the use of tiles of different shapes, which entails a higher cost given the complexity of manufacturing different pieces and the difficulties during their transport as well as their laying on a surface (floor or wall) are increased.

In addition, for these types of parts with specific surface configurations to be profitable, manufacturing processes for large runs must be implemented, which also requires having a large number of stocks and variable assortments, which causes a decrease in the effectiveness and profitability of the manufacturing, logistics and assembly processes of this type of parts.

SUMMARY OF THE INVENTION

The present invention has been developed with the purpose of providing a tile which is configured as a novelty within the field of application and solves the aforementioned drawbacks, further contributing other additional advantages that will be obvious from the description below.

An object of the present invention is therefore to provide a tile for cladding and paving that allows a wide variety of decorations that facilitates its laying, either during transport operations, as well as laying on a surface to be cladded at a lower cost with regarding the laying of individual pieces, as is carried out currently. Such a tile comprises a single body made from a ceramic material, which is characterized in that it comprises a main area that has a substantially polygonal plan having between five and ten sides, and at least one additional area located on at least one side of the main polygonal area, each additional area having an irregular polygonal plan, such that one of the longer sides of the additional area faces one of the sides of the main area.

In this disclosure, "polygonal between five and ten sides" is understood to mean both a pentagon, a hexagon, a heptagon, an octagon, a nonagon, and a decagon.

In a preferred embodiment of the tile of the invention, three additional areas with an irregular hexagonal shape are provided, and they are arranged on alternate sides of the main hexagonal-shaped area.

Additionally, in another preferred embodiment of the tile of the invention, three additional areas with an irregular hexagonal layout are provided, and they are arranged on contiguous sides of the main hexagonal-shaped area.

In an alternative embodiment of the invention, two additional areas are provided, and they are arranged on two contiguous sides of the main area, also with a hexagonal shape.

In another alternative embodiment, the main area has a different surface finish from the additional areas.

Other features and advantages of the tile object of the present invention will be evident in light of the description of a preferred, but not exclusive, embodiment which is illustrated by way of a non-limiting example in the drawings which are attached, wherein:

DESCRIPTION OF A PREFERRED EMBODIMENT

In light of the aforementioned figures, and in accordance with the adopted numbering, one may observe therein a preferred exemplary embodiment of the invention, which comprises the parts and elements indicated and described in detail below.

As represented in the figures, the tile intended for cladding and paving a surface comprises a single body made from a ceramic material, having a main area (1) that has a substantially polygonal plan having between five and ten sides, and at least one additional area (2) located on at least one side of the main area, each additional area having an irregular polygonal plan, such that one of the longer sides of the additional area (2) faces one of the sides of the main area (1).

Figure 1:
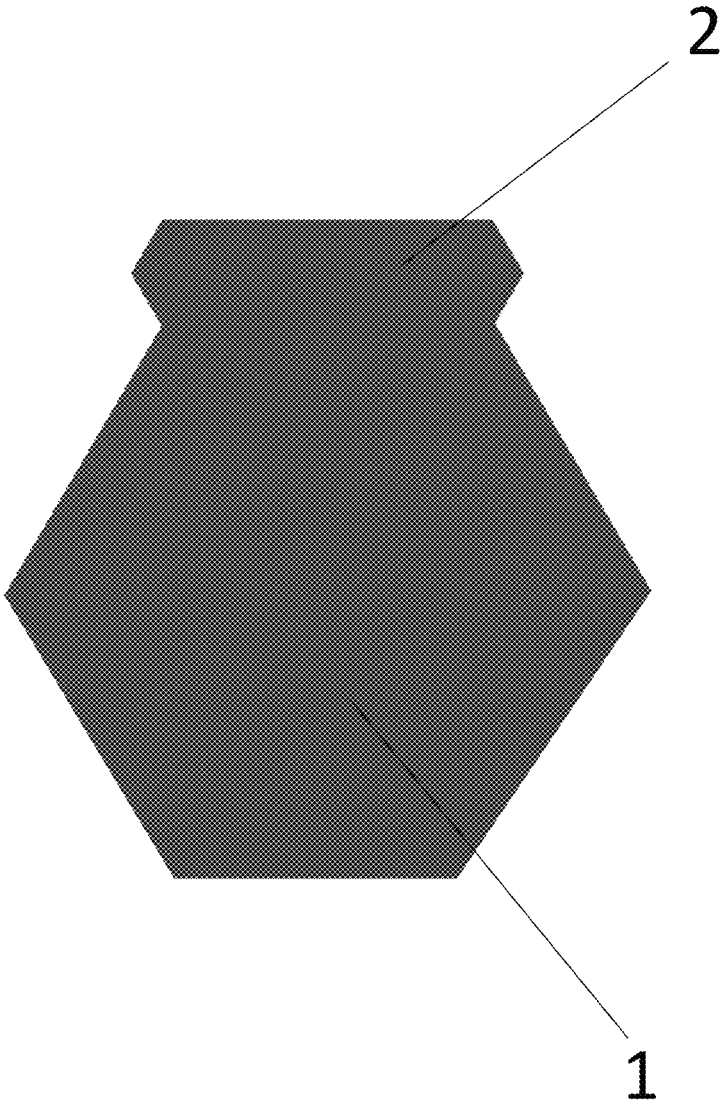
FIG. 1 is a FIG. 1 is a plan view of an embodiment of a tile according to the present invention.

FIG. 1 shows an embodiment of the previously described tile in which the additional area (2) has an irregular hexagonal shape, and it is arranged on one side of the main area (1), which is also a hexagonal shape.

Figure 2:
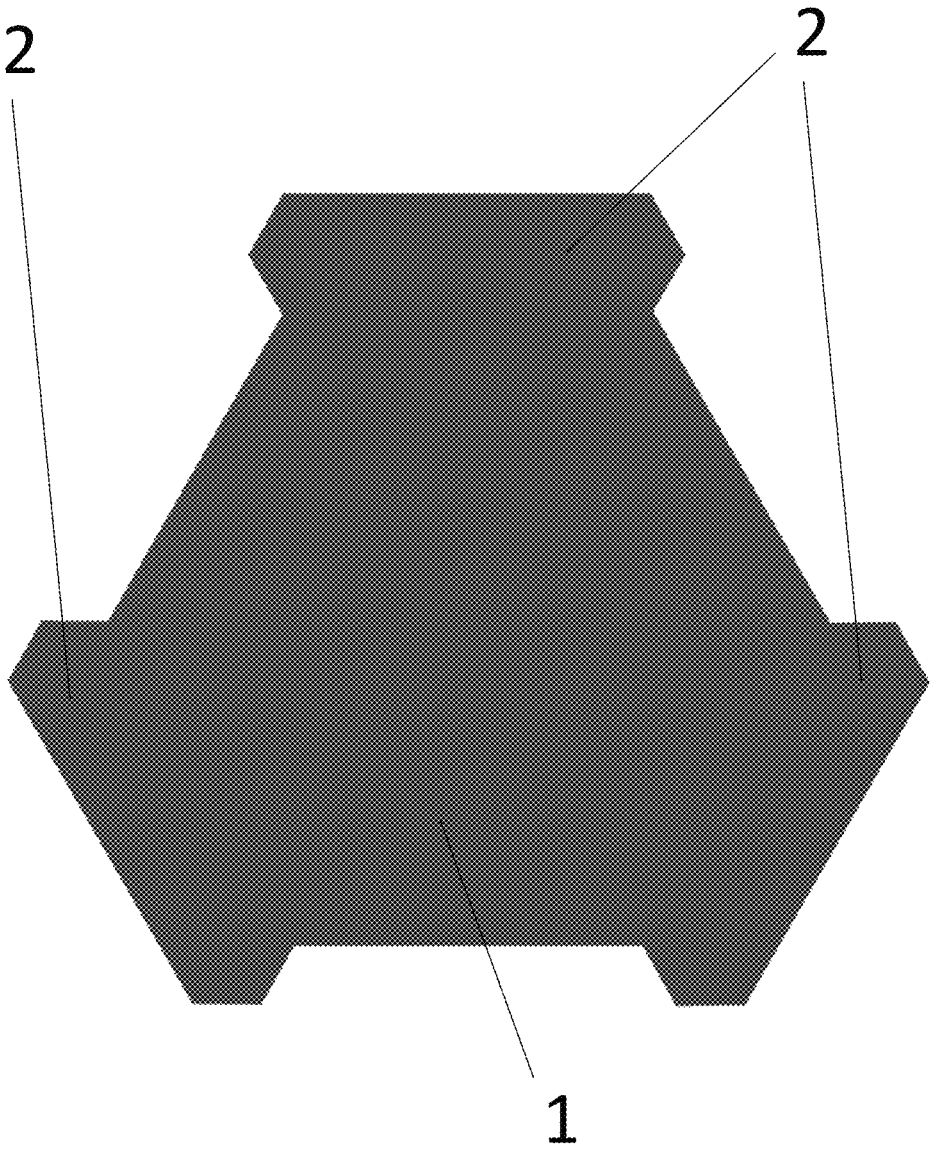
FIG. 2 is a plan view of a preferred embodiment of the tile of the invention.

FIG. 2 shows a preferred embodiment of the present invention, in which the same numerical references are used as in FIG. 1, and in which the main are incorporates three additional areas (2), which are arranged on three alternate sides of the said main area (1) with a hexagonal shape.

Figure 3:
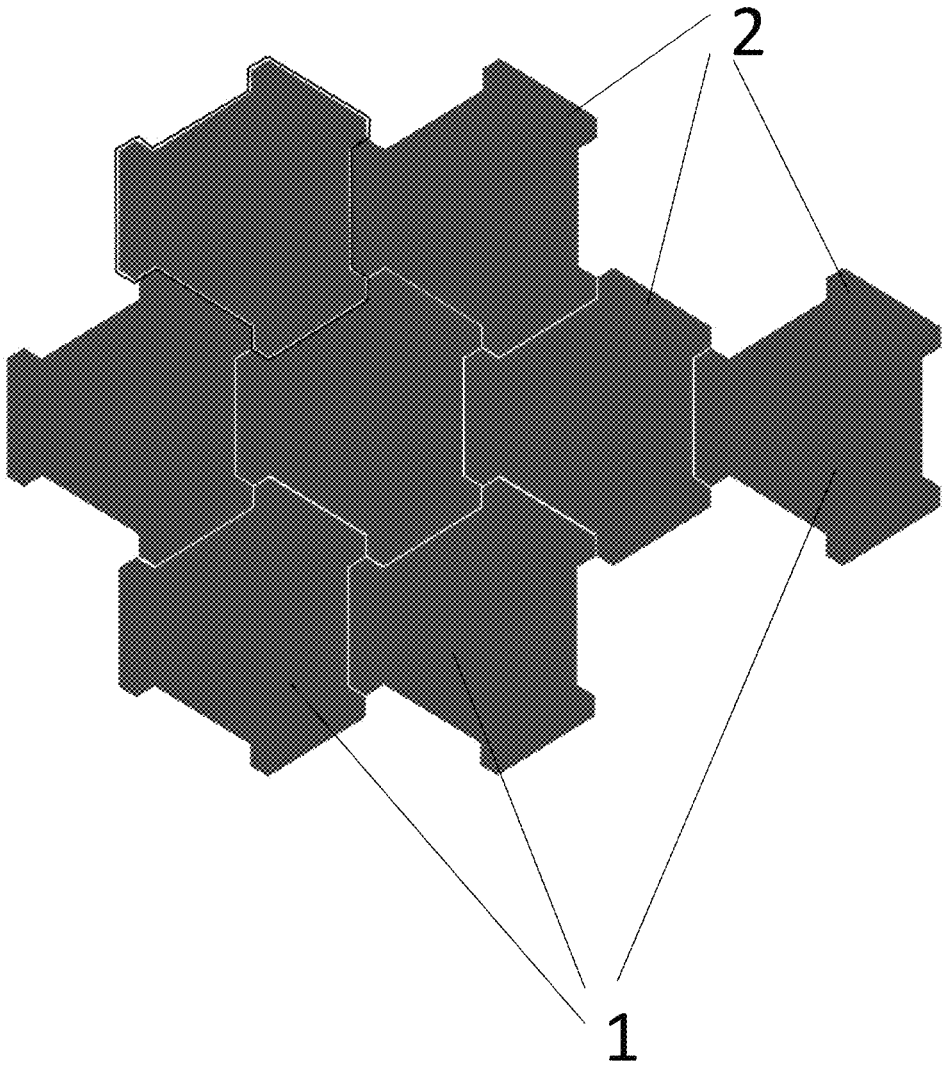
FIG. 3 is a plan view of a matrix of tiles according to the embodiment shown in FIG. 2, coupled together.

FIG. 3 shows the arrangement of a matrix of equal tiles, according to a preferred embodiment of the invention, in more detail in the FIG. 2, coupled together, in order to represent the paved and/or cladded surface that can be obtained by means of the tile of the invention, in one of its possible embodiments.

Figure 4:
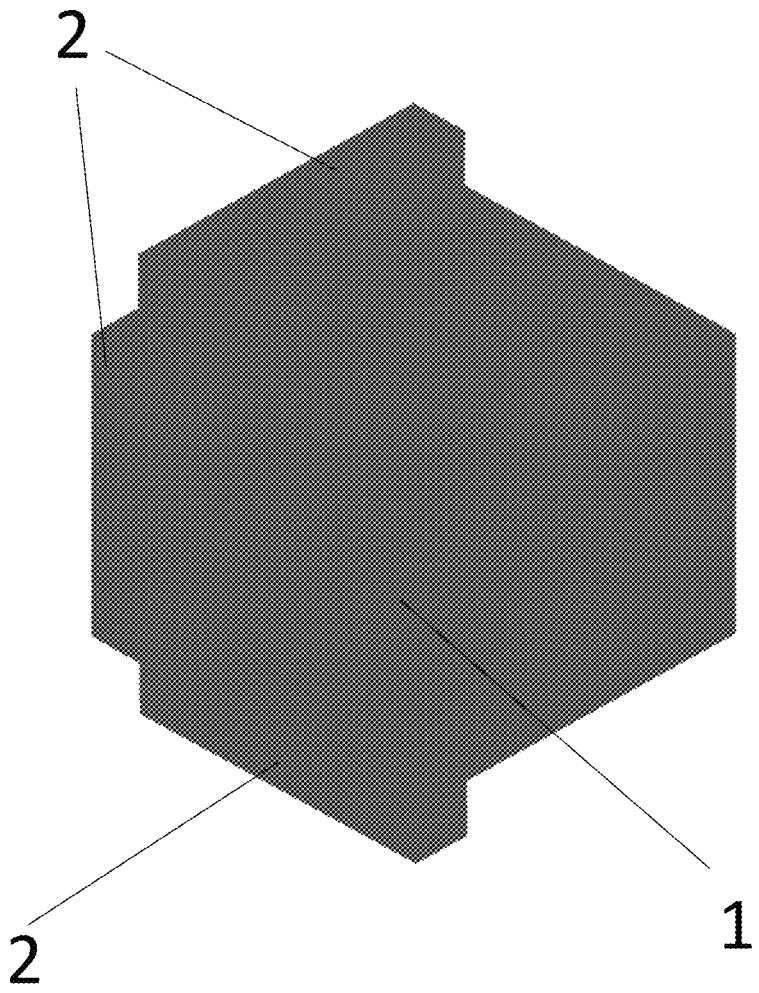
FIG. 4 is a plan view of another preferred embodiment of the tile of the invention.

FIG. 4 shows another preferred embodiment of the present invention, in which the same numerical references are also used as in the FIG. 1, and in which the main area incorporates three additional areas (2), which are arranged on three contiguous sides of said main area (1) with a hexagonal shape too.

Figure 5:
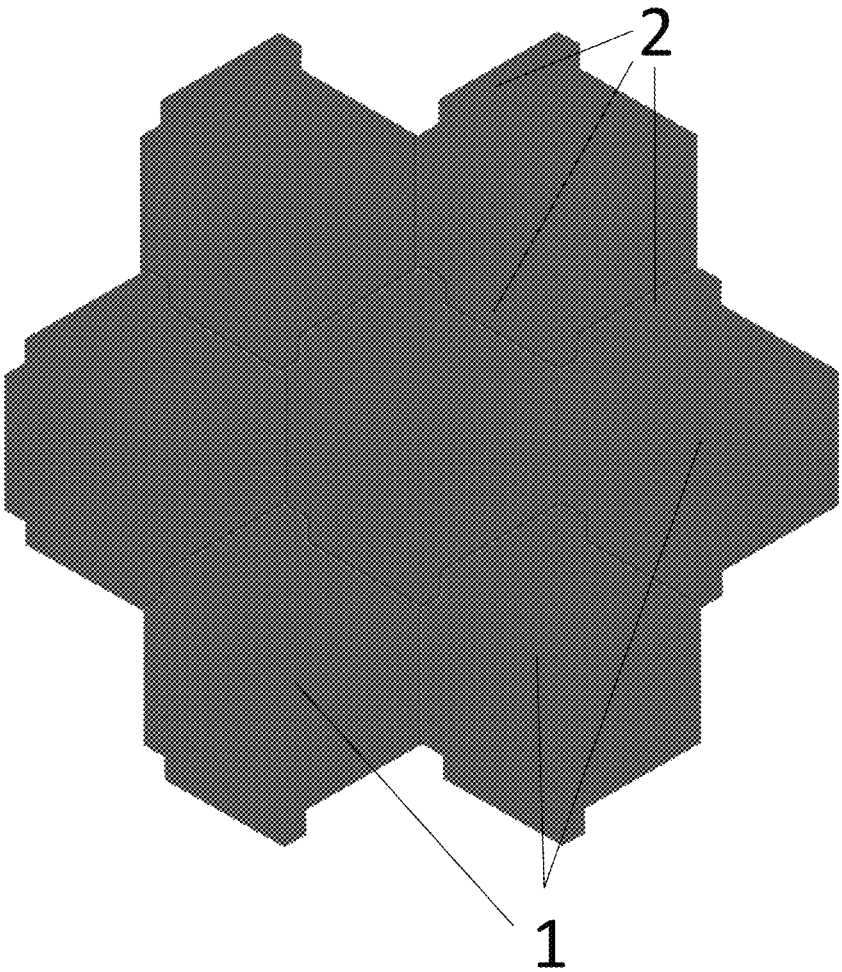
FIG. 5 is a plan view of a matrix of tiles according to another embodiment of the invention, shown in FIG. 4, coupled together.

FIG. 5 shows the arrangement of a matrix of equal tiles, according to another preferred embodiment of the invention, shown in FIG. 4, coupled together, in order to represent the paved and/or covered surface that can be obtained by means of the tile of the invention, in one of its possible embodiments.

The details, shapes, dimensions and other secondary elements, used to manufacture the sealing element of the invention, may be suitably replaced with others that do not depart from the scope defined by the claims included below.

The invention claimed is:

1. A tile for cladding and for paving, which comprises a single body made from a ceramic material, comprising a main area that has a substantially polygonal plan having between five and ten sides, and at least one additional area located on at least one side of the main area, each additional area having an irregular polygonal plan, such that one of the longer sides of the additional area faces one of the sides of the main area; and the main area (1) has a different surface finish from the at the least one additional area.

2. The tile according to claim 1, wherein main area has a hexagonal shape.

3. The tile according to claim 2, wherein the at least one additional comprises three additional areas with an irregular hexagonal shape, which are arranged on alternate sides of the main hexagonal-shaped area.

4. The tile according to claim 2, wherein the at least one additional area comprises three additional areas with an irregular hexagonal shape, which are arranged on contiguous sides of the main hexagonal-shaped area.

5. The tile according to claim 1, further comprising two additional areas, which are arranged on two contiguous sides of the main area.

* * * * *